US005649342A

United States Patent [19]

D'Andrade et al.

[11] Patent Number: 5,649,342

[45] Date of Patent: Jul. 22, 1997

[54] DECORATIVE DEVICE FOR ATTACHMENT TO AND SECURING OF SHOELACES

[75] Inventors: Bruce M. D'Andrade, Whitehouse Station; Jay E. Campbell, Clinton, both of N.J.

[73] Assignee: Seneca Enterprises, Inc., Whitehouse Station, N.J.

[21] Appl. No.: 679,610

[22] Filed: Jul. 10, 1996

[51] Int. Cl.[6] ..... A43C 7/00

[52] U.S. Cl. ..... 24/712.2

[58] Field of Search ..... 24/712.1, 712.2, 24/712.3, 712.6; 36/50.1

[56] References Cited

U.S. PATENT DOCUMENTS

| | | | |
|---|---|---|---|
| 1,446,663 | 2/1923 | Sandberg . | |
| 1,806,162 | 5/1931 | Hahn | 24/712.6 |
| 2,035,174 | 3/1936 | McIlhenny . | |
| 3,132,394 | 5/1964 | Russell . | |
| 3,345,707 | 10/1967 | Rita | 24/712.2 |
| 3,473,198 | 10/1969 | Meier . | |
| 4,715,094 | 12/1987 | Herdman | 24/712.3 |
| 4,805,270 | 2/1989 | Kimbrough . | |
| 5,022,127 | 6/1991 | Ang . | |
| 5,029,371 | 7/1991 | Rosenblood et al. . | |
| 5,099,552 | 3/1992 | Kimbrough . | |
| 5,402,589 | 4/1995 | Lubrani et al. | 24/712.3 X |

*Primary Examiner*—James R. Brittain
*Attorney, Agent, or Firm*—Kenneth P. Glynn, Esq.

[57] ABSTRACT

The present invention device for securing shoelaces includes a base, a cover and an attachment mechanism for hingedly connecting the base and cover. The base has at least a bottom, a front and a back. The bottom has side cutouts adapted to allow a shoelace to pass therethrough. A pair of opposing slits extend from the side cutouts towards the center, but do not overlap. The opposing slits are formed so that the shoelace may pass easily from the side cutouts to the opposing slits. Each slit is sized and shaped such that it frictionally engages the shoelaces when they are pulled through it. In a further embodiment, the present invention has a support structure which can be attached to the footwear and then coupled with the base. In this embodiment, the base and support have complementary attachment mechanisms.

20 Claims, 8 Drawing Sheets

DECORATIVE DEVICE FOR ATTACHMENT TO AND SECURING OF SHOELACES

BACKGROUND OF THE INVENTION

1. Field of the Invention

The present invention is directed to a device for attachment to and securing of securing shoelaces. More specifically, the present invention is directed to a device which is used to clasp shoelaces before they are tied and may even be used to secure the shoelaces in an untied state. The present invention also allows the shoelace bows (i.e. when in a tied state) to appear inside or outside of the present device. Advantageously, the present invention shoelace attachment and securing devices may include characters, figures or other amusement aspects for decorative or entertainment purposes. Thus, the present invention devices are used functionally to attach to shoelaces and secure same and are used as decorative or ornamental devices as well.

2. Information Disclosure Statement

A number of devices have been developed which create ornamental and/or functional aspects to shoelaces. These devices typically take the form of famous cartoon characters or comic book characters or children's heroes and are predominately ornamental, although functional aspects are included. The following U.S. patents represent the state-of-the-art in this field:

U.S. Pat. No. 1,446,663 issued to C. J. Sandberg on Feb. 27, 1923 teaches a device which relates to improvements in the means of retaining and concealing the lace-tie of footwear. The primary object of this device is to provide a lace-tie retainer which will not cause discomfort to the wearer and which can be securely tied to the shoe by the shoelace, and which although being easily and quickly attached and detached, can be securely fastened.

U.S. Pat. No. 2,035,174 issued to W. H. McIlhenny on Mar. 24, 1936 teaches a device which relates particularly to a clasp designed to prevent the loosening of a shoelace after it has been drawn into position and tied. When mounted, it becomes a unitary part of the shoe and lace assembly. It also teaches a clasp that may be applied to any method of lacing and that will not interfere with the tying of the lace in the customary manner. It is also an object of the McIlhenny invention to provide a clasp that will be inconspicuous when in use and that will not disfigure the shoe upon which it is placed.

U.S. Pat. No. 3,132,394 issued to D. P. Russell on May 12, 1964 teaches a device which provides a protective encasement for the knot in the laces, rendering the knot inaccessible to the child. The device may also be made in numerous attractive designs to lend a decorative touch to the shoe. Such designs may also be such that older children may use the devices for decorative purposes and, therefore, this device is not restricted to use by young children.

U.S. Pat. No. 3,473,198 issued to E. Meier on Oct. 21, 1969 describes an enclosure adapted to be attached to a shoe in such a manner so that the tie of the shoe can be locked within the enclosure. The enclosure is formed of two halves which are hingably attached to one another and is provided with a hidden latching means which requires the use of a thin object such as a coin to be unlocked.

U.S. Pat. No. 4,805,270 issued to R. Kimbrough on Feb. 21, 1989 describes an apparatus for securing a shoelace during intermediate stages of shoelace tying as well as after tying. First and second jaw members define a jaw opening and are adapted for mounting on a shoe with the jaw opening facing away from the shoe. At least one of the jaw members is displaceable away from the jaw opening and is biased in a closed position. A portion of the periphery of at least one of the jaw members adjacent the jaw opening is inclined toward the jaw opening to define a camming surface for guiding the shoelace to the jaw opening and for permitting the force of the shoelace being pulled to displace the movable jaw member against the biasing force so that the shoelace can enter and be retained in the apparatus. The jaw members can include a cavity to receive a knot and teeth at the periphery of the jaw opening for retaining the lace. The movable jaw member is mounted by an over center hinge permitting selective opening of the apparatus to release a knot.

U.S. Pat. No. 5,022,127 issued to J. Ang on Jun. 11, 1991 describes a shoelace locking device with a base with holes through which shoelaces can be threaded to attach it to a shoe. The base has a first well in which the knot can rest, and a plurality of serrated projections for retaining the laces. The base has a flexible elastic sheath integral with an elastic hinge and cover. The cover has a matching second well for receiving part of the knot. An elastic latch on the cover can be pulled over a catch on the base to lock the assembly closed and prevent the knot from untying.

U.S. Pat. No. 5,029,371 issued to K. Rosenblood et al. on Jul. 9, 1991 teaches a locking device which has two sets of pairs of aligned clamping teeth, each set holding one lace end of an elastic lace. Each pair of aligned clamping teeth has a lace insertion portion for snapping an elastic lace laterally through it into a lace holding portion. Last pairs of aligned clamping teeth are dimensioned to hold the elastic lace tighter than the remaining pairs. A pair of cleats may be used to clasp a shoelace as it comes out of a shoe eyelet so that any further tensioning of the lace will not affect the tightness of the shoe. A shoe hook may also be placed on the back of the locking device.

U.S. Pat. No. 5,099,552 issued to R. Kimbrough on Mar. 31, 1992 describes a device for decorating laces formed from a body which has a first bore extending from a first end of the body to a second end of the body and a second bore extending from the second end of the body. The tip of a lace passes through the first bore from the first end to the second end and is then received in the second bore and retained therein when the end of the lace extending past the first end is pulled. A full or partial wall is defined between the bores in the vicinity of the first end for retaining a loop of the lace. A groove may be formed in the second end between the first and second bores for receiving the loop of the lace.

Notwithstanding the above-cited prior art, the present invention is neither taught nor rendered obvious thereby.

SUMMARY OF THE INVENTION

The present invention device for securing shoelaces includes a base, a cover, and a connecting mechanism for hingedly connecting the base and cover. The base has at least a bottom, a front and a back. The bottom has a side cutout portion adapted to allow a shoelace to pass therethrough from a cavity defined by the bottom and a section of the shoe. A pair of slits extend partially from the side cutout portion towards a center section of the bottom to allow the shoelaces to be pulled toward each other. Each slit is sized and shaped so that it frictionally engages the shoelace and effectively secures the shoelaces without tying a knot, and when in a knotted condition, helps prevent the knot from being loosened. In a further embodiment, the bottom of the base includes an optional attachment mechanism for coupling with a support structure positioned on a tongue of the shoe. The support structure may be sewn or glued onto the tongue of the shoe.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
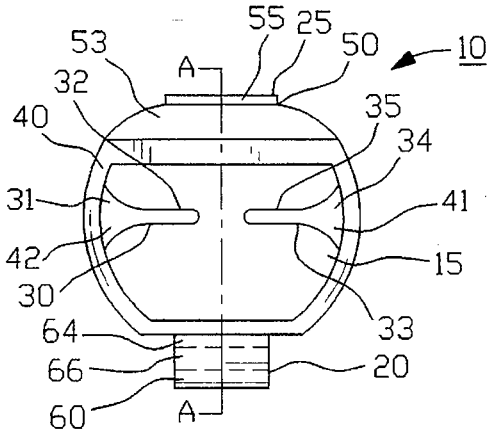
FIG. 1 shows a rear view of a bottom of a base component of the present invention.
Figure 2:
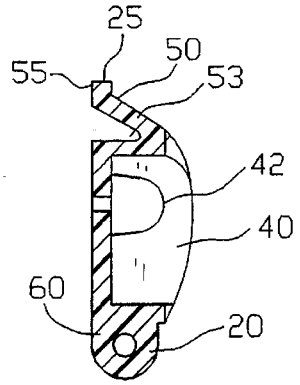
FIG.2 shows a side cross-sectional view along section A—A of the embodiment shown in FIG. 1.
Figure 3:
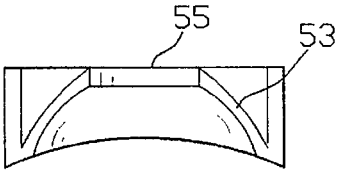
FIG. 3 shows a top view of the embodiment shown in FIG. 1.
Figure 4:
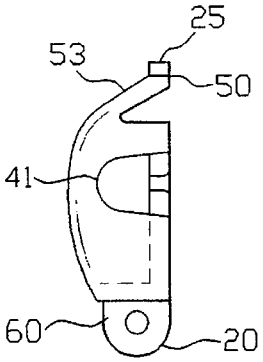
FIG. 4 shows a side view of the embodiment shown in FIG. 1.
Figure 5:
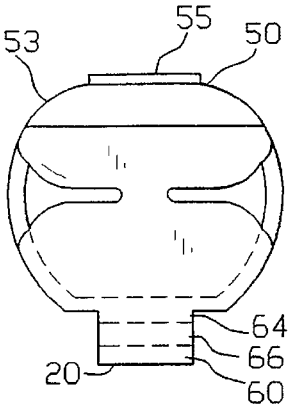
FIG. 5 shows a front view of the embodiment shown in FIG. 1.

The present invention is a device which is attached to and used for securing shoelaces. It is applicable for laces on shoes, sneakers and other footwear. It is applied to the footwear after it has been laced up. The devices may be made of plastic, metal, composites or other materials and/or combinations of the above. However, the devices are typically formed of molded plastic. The devices are multifunctional, in that they can be used for securing the laces and storing the ends inside the cover component. Alternatively, they could be used for storing a knot formed from the laces and displaying the bow configuration. The device can be used with or without tying the laces in a knot.

The devices of the present invention secure the laces via a pair of slits through which the ends of the shoelaces are drawn together towards the center portion. The slits are sized and shaped so as to frictionally engage the shoelaces. Therefore, once the shoelaces are pulled through the slits, the frictional engagement action of the slits helps keep the shoelaces secure even in an untied state. The shoelaces are threaded through a cavity area defined by the base and the footwear. They are then brought up through a side cutaway section and pulled together towards the center portion.

Referring to FIGS. 1–5, there is shown a front view, cross sectional side view, top view and side view of a base 10 of a device of the present invention, which is generally depicted as 1. Base 10 has a bottom 15, a front 20 and a back 25.

Bottom 15 has a pair of opposing slits 30,33 which are generally Y-shaped. Each of opposing slits 30,33 are adapted to allow the shoelace to pass therethrough and to frictionally engage the shoelace after the shoelace is no longer being pulled. The wide sections 31,34 of each of opposing slits 30,33 are at an outer circumference of bottom 15. Narrow sections 32,35 of opposing slits 30,33 extend from wide sections 31,34 towards the center of bottom 15, but do not extend so as to overlap. Pair of opposing slits 30,33 are typically symmetrical and are positioned approximately 180° apart. However, it is possible that the geometry of the slits and the side cutaways (as described below) could be at other angles.

Base 10 has a peripheral top rim 40 which has portions with a lower height at side cutaway sections 41,42 corresponding to wide sections 31,34 of opposing slits 30,33. Side cutaway sections 41,42 have a U-shaped configuration and have each mouth facing in the direction of where a cover 90 would be positioned when device 1 is in a closed state. This permits easy access when threading the shoelace and permits the shoelaces to extend outwardly from device 1 when it is in a closed state.

A latching mechanism 50 for fastening base 10 to a cover 90 (described below) is partially situated at a back 25 of base 10. Latching mechanism 50 of base 10 includes a diagonal wall 53 extending from peripheral top rim 40 and ending in typically a ledge section 55 as used in snap-on type lids. Diagonal wall 53 is angled such that ledge section 55 can engage/disengage from cover 90 when required by the user but not accidentally.

Base 10 further includes sections of a hinge mechanism 60, which connects base 10 to cover 90. Front 20 of base 10 has an extension section 64 with an orifice 66 therethrough for a hinge pin (not shown). Alternatively, the hinge pin could be unistructurally formed of plastic and thus, extension section 64 would not have an orifice or hollow section area.

Figure 6:
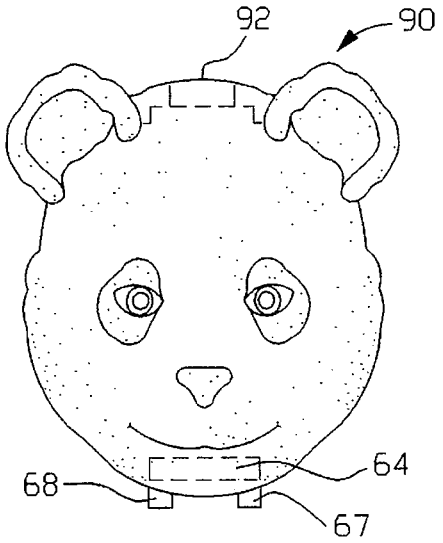
FIG. 6 shows an embodiment of a cover component of the present invention.
Figure 7:
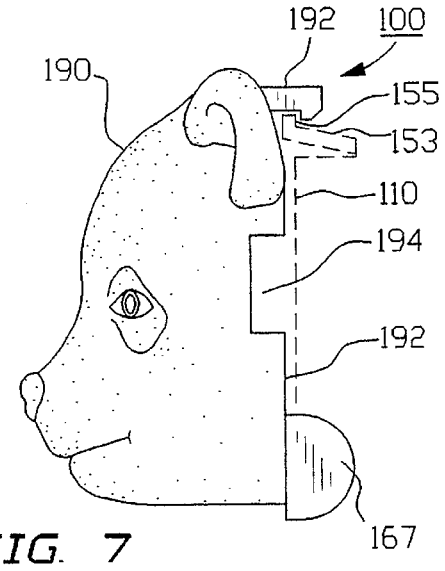
FIG. 7 shows a side view of the cover component with a notched area.
Figure 8:
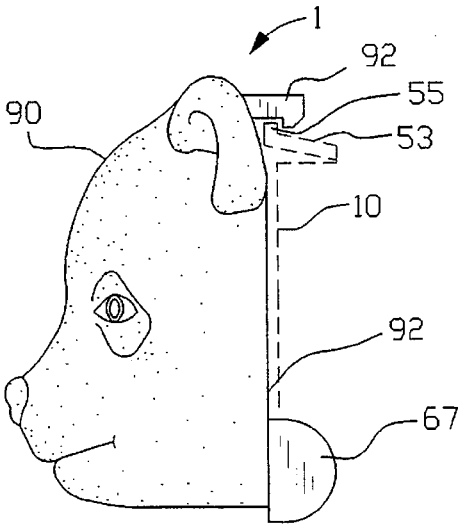
FIG. 8 shows an alternative embodiment of the cover component.
Figure 11:
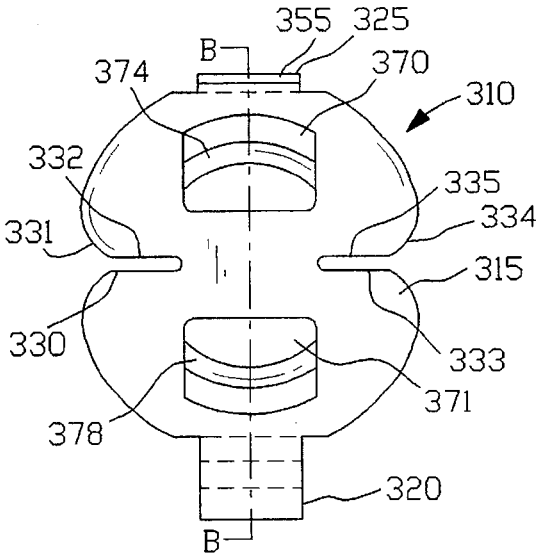
FIG. 11 shows a front view of an alternative embodiment of the base component with attachment mechanism for support structure.
Figure 12:
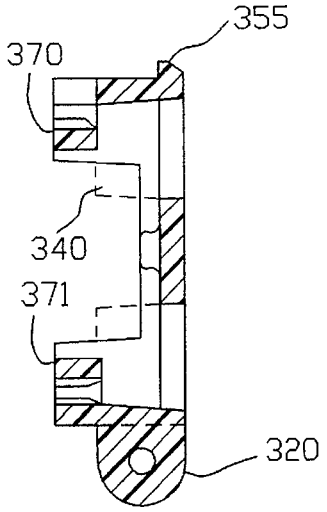
FIG. 12 shows a side cross-sectional view along section B—B of the embodiment shown in FIG. 11.
Figure 13:
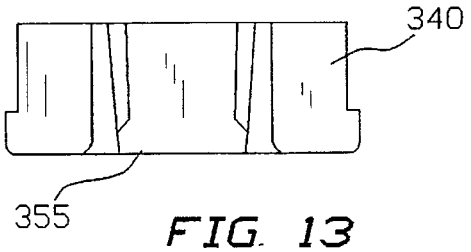
FIG. 13 shows a top view of the embodiment shown in FIG. 11.
Figure 14:
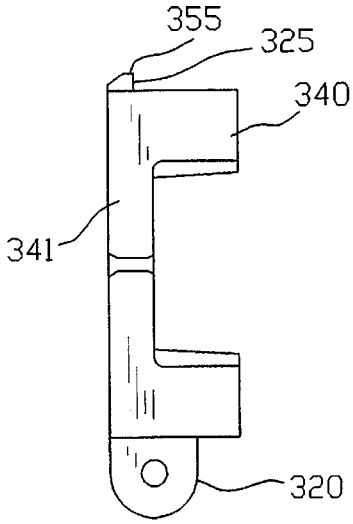
FIG. 14 shows a side view of the embodiment shown in FIG. 11.
Figure 15:
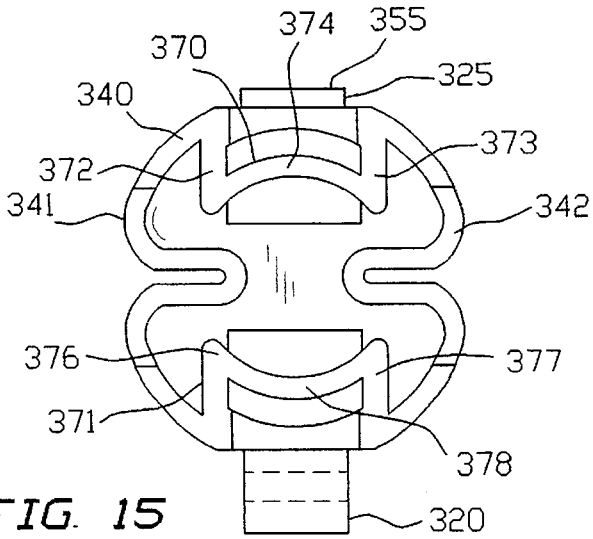
FIG. 15 sows a rear view of the embodiment shown in FIG. 11.
Figure 16:
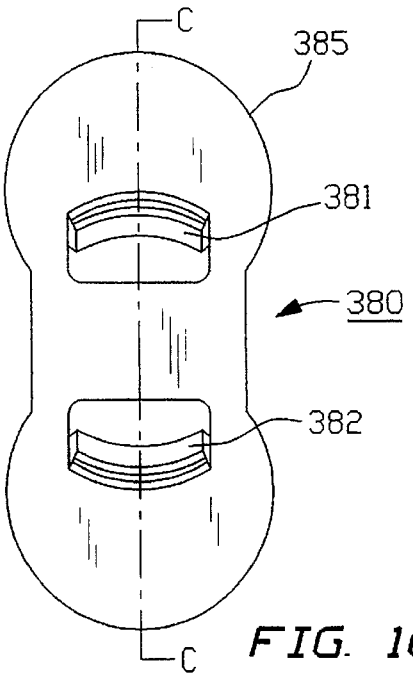
FIG. 16 shows a front view of a support structure of the present invention.
Figure 17:
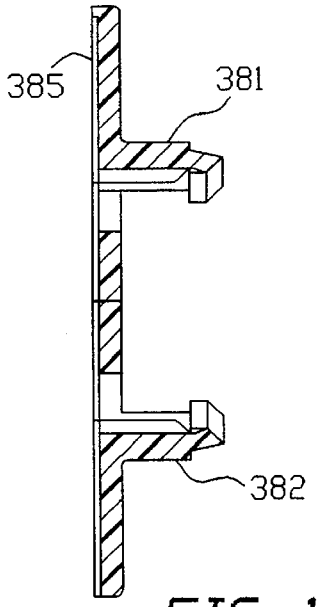
FIG. 17 shows a side cross sectional view along section C—C of the support structure of FIG. 16.
Figure 18:
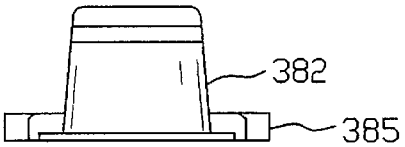
FIG. 18 shows a top view of the support structure of FIG. 16.
Figure 19:
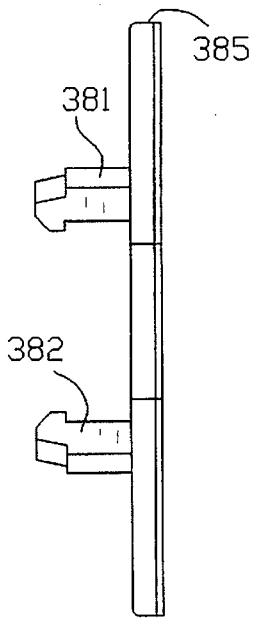
FIG. 19 shows a side view of the support structure of FIG. 16.

Referring now also to FIGS. 6–8, a cover 90 of the present invention is shown. Cover 90 and base 10 are attached to each other via latching mechanism 50 and hinge mechanism 60. In a closed condition, a rear surface 92 is aligned substantially parallel to base 10 as shown in FIG. 8. Latching mechanism 50 of cover 90 includes a front snap-on under cut extended ledge 92 which mates with diagonal wall 53 and ledge section 55 of base 10 when device 1 is in a closed condition. Hinge mechanism 60 of cover 90 includes a pair of hinge pin blocks 67,68 onto which fits extension section 64 of front 20. A pin (not shown) joins hinge pin blocks 67,68 and extension section 64 so that cover 90 is hingedly connected to base 10.

An alternate embodiment of cover 90 is depicted in FIG. 7. This embodiment is similar to the above embodiment and identical parts are numbered the same but beginning with "1". A rear surface 192 has a cut-out segment 194 across the middle of cover 190 which facilitates permitting shoelaces to extend outwardly when cover 190 and base 110 are in a closed condition. Typically, cover 90 or 190 has a character or other ornamental design, such as a face of a person or an animal. Alternatively, cover 90 or 190 could be a plain cover on which the user could mark or write something on.

Referring now to FIGS. 1–6, 7 (or 8), 21–22 and 27, an operational description of device 1 (or 100) is given. Identical part's are identically numbered for the sake of clarity. One end of the shoelace 705 is threaded through from the underside of bottom 15 through orifice 715 formed by side cutaway sections 41,42 and wide sections 31,34. Another end of another shoelace 710 is similarly threaded through opposing orifice 720. Both ends 705,710 are then pulled together through opposing slits 30,33, respectively. The shoelaces may then be tied together to form a knot or be left untied. In either case, cover 90 and base 10 are then snapped together, which would secure the tied or untied shoelaces. FIG. 29 illustrates the outcome when the shoelaces are tied and left outside the present invention in the form of bows.

Figure 9:
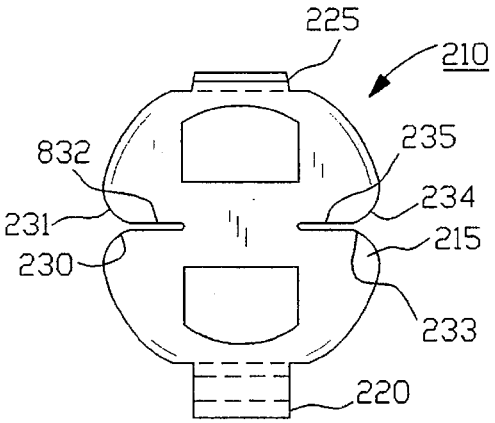
FIG. 9 shows an alternative embodiment of the base component from a rear view.
Figure 10:
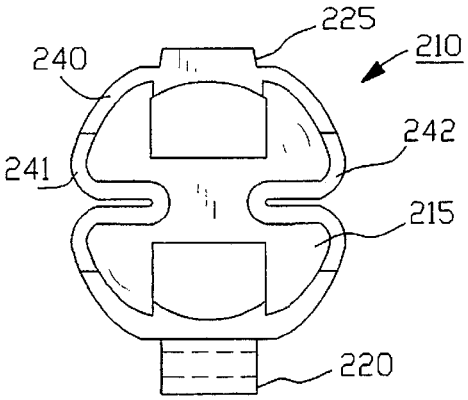
FIG. 10 shows a front view of the base component of FIG. 9.

FIGS. 9 and 10 show a front and rear view of an alternative embodiment base 210. Base 210 includes a bottom 215, a front 220 and a back 225.

Bottom 215 has a pair of opposing slits 230,233 which are generally Y-shaped. Each of opposing slits 230,233 are adapted to allow the shoelace to pass therethrough and to frictionally engage the shoelace after the shoelace is no longer being pulled. The wide sections 231,234 of each of opposing slits 230,233 are at an outer circumference of bottom 215. Narrow sections 232,235 of opposing slits 230,233 extend from wide sections 231,234 towards the center of bottom 215 and towards each other, but do not extend so as to overlap. Pair of opposing slits 230,233 are typically symmetrical and are positioned approximately 180° apart.

Base 210 has a peripheral bottom rim 240 which has portions with a lower height at side cutaway sections 241, 242 corresponding generally to the position of wide sections 231,234 of opposing slits 230,233. More specifically, side cutaway sections 241,242 have rim 240 fully removed. Side cutaway sections 241,242 permit the shoelaces to be easily threaded through to opposing slits 230,233 from underneath bottom 215. Cover 290 is constructed and functions in the same manner as described above.

A latching mechanism 250 for fastening base 210 to a cover 290 is similar to that described previously. In this embodiment, latching mechanism 250 includes a ledge section 255 positioned on back 225 of base 210.

Similar to the previous embodiment, base 210 and cover 290 includes sections of a hinge mechanism 260, which connects base 210 to cover 290.

Referring now also to FIGS. 9–10, 23–24 and 27, an operational description of this embodiment is given. Shoelace ends 805 and 810 are pulled from the underside of bottom 215 and into opposing slits 230,233. Due to the size of opposing slits 230,233, the shoelaces are pinched by opposing slits 230,233 and prevented from freely moving after the shoelace is initially pulled. As before, the shoelaces can be tied or remain untied. Cover 290 is then attached to base 210 as in the previous embodiment and results as shown in FIG. 29. Cover 290 can be either the straight version shown in FIG. 8 or the notched version shown in FIG. 7.

Referring now to FIGS. 11–15, there is shown another embodiment of a base 310. Base 310 is similar in structure to base 210 but has additional structure for engaging a support 380. Base 310 has a pair of engagement lock apertures 370,371 on bottom 315. Each engagement lock aperture 370,371 is defined by a pair of side walls 372,373 and 376,377 and having a height equal to rim 340, and a pair of curved bars 374,378 positioned off of side walls 372,373 and 376,377, respectively.

Referring now to FIGS. 16–19, support 380 includes a pair of engagement arms 381,382 extending from a base support 385. Engagement arms 381,382 are curved in the same shape as engagement lock apertures 270,271 of base 310. Engagement arms 381,382 are constructed such that movement is allowed for when the present invention is in a snapped together state. Support 380 is attached to the tongue of the footwear in question by sewing or gluing or the like. In an alternative embodiment, the present invention has only one engagement lock and engagement arm.

Figure 20:
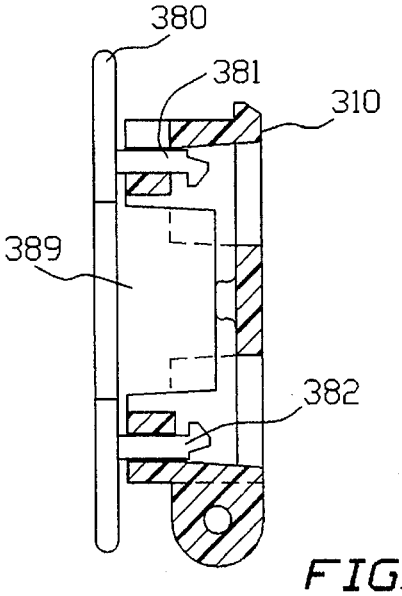
FIG. 20 shows an interlocking view of the base and the support structure of the present invention.
Figure 22:
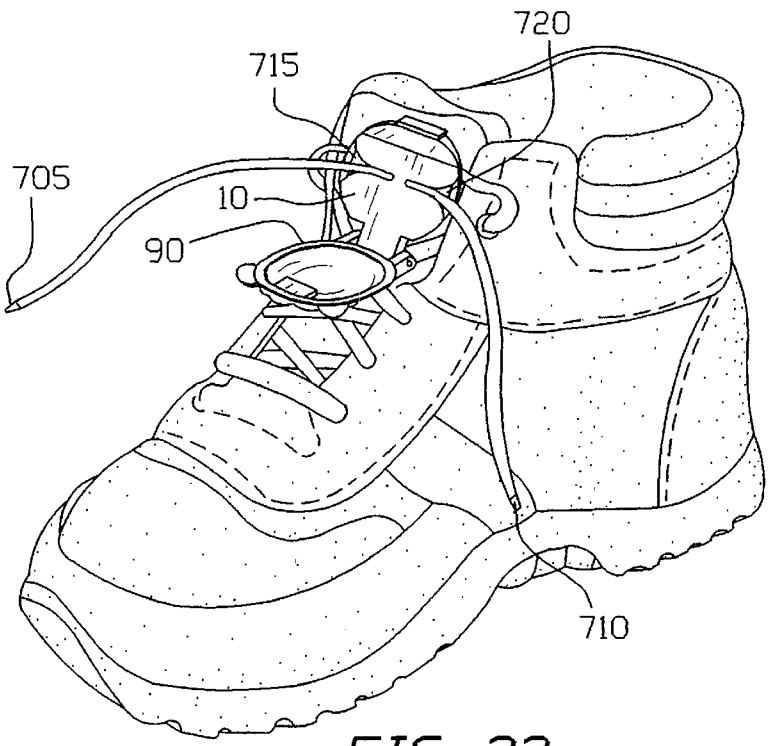
FIGS. 21 and 22 show an operational perspective of the embodiment shown in FIGS. 1–5.
Figure 21:
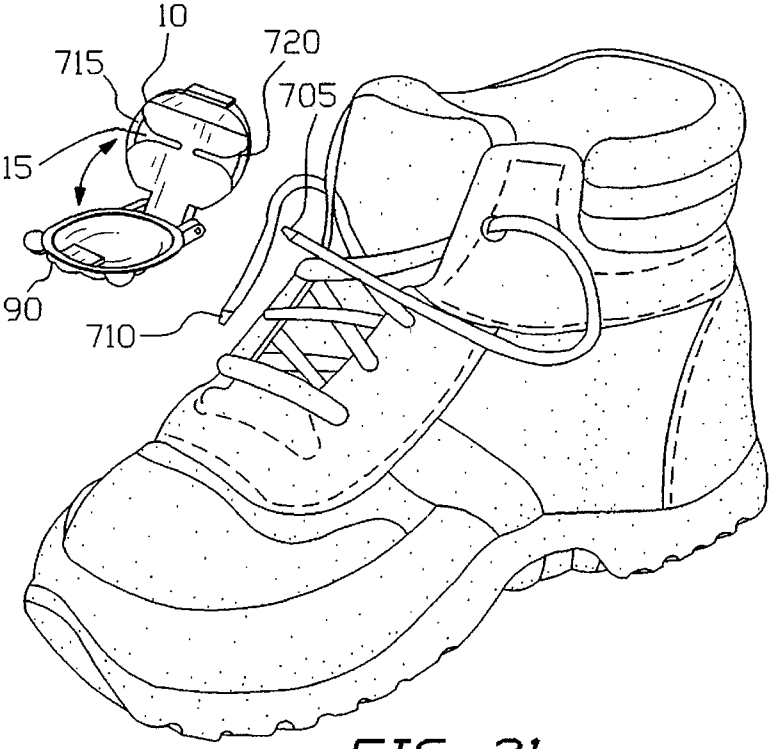
Figure 24:
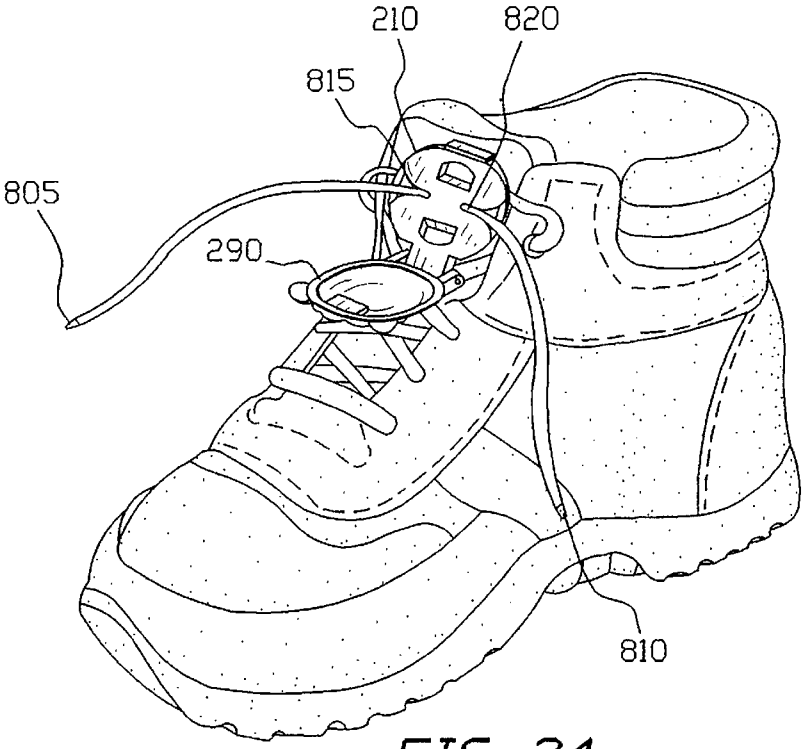
FIGS. 23–24 show an operational perspective of the embodiment shown in FIGS. 9 and 10.
Figure 23:
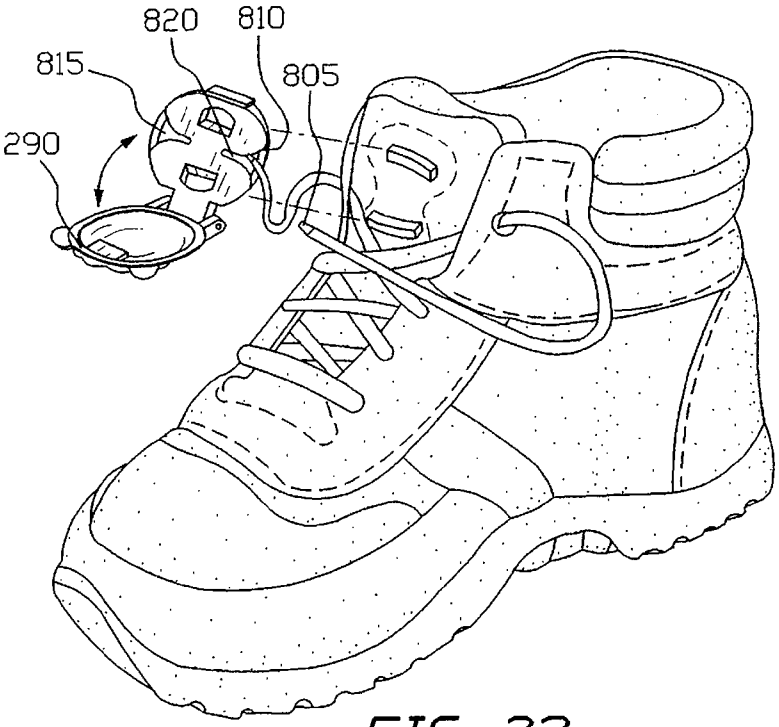

Referring now to FIG. 20, there is shown a cross section of an assembled base 310 and support 380. Support 380 is attached to base 310 so that a cavity 389 is created between support 380 and base 310, which allows for threading of the shoelace under and through base 310.

Operationally, support 380 is force snapped together with base 310. The curved shape of engagement lock apertures 270,271 creates geometrically rigid and positive interference lock pockets that act against mating engagement arms 381,382. Thus, once support 380 and base 310 are together they cannot be easily separated. However as stated earlier, the construction of engagement arms 381,382 allow base 310 a degree of movement even when in the snapped together state. This makes it easier for the user to thread the laces through the device after the device is in snapped together state, i.e. when the user uses the footwear a second or later time.

Figure 26:
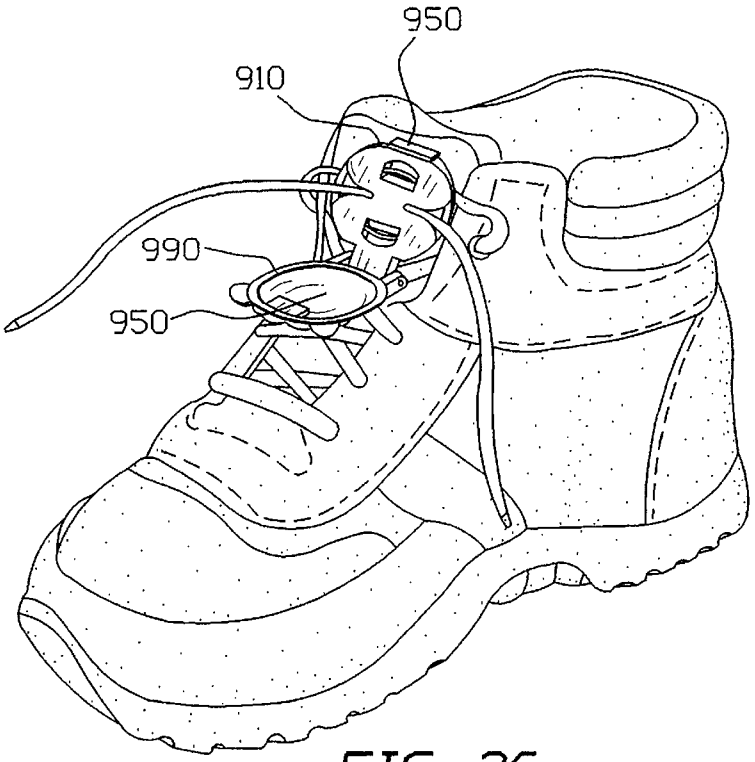
FIGS. 25–26 show an operational perspective of the embodiment shown in FIGS. 12–20.
Figure 25:
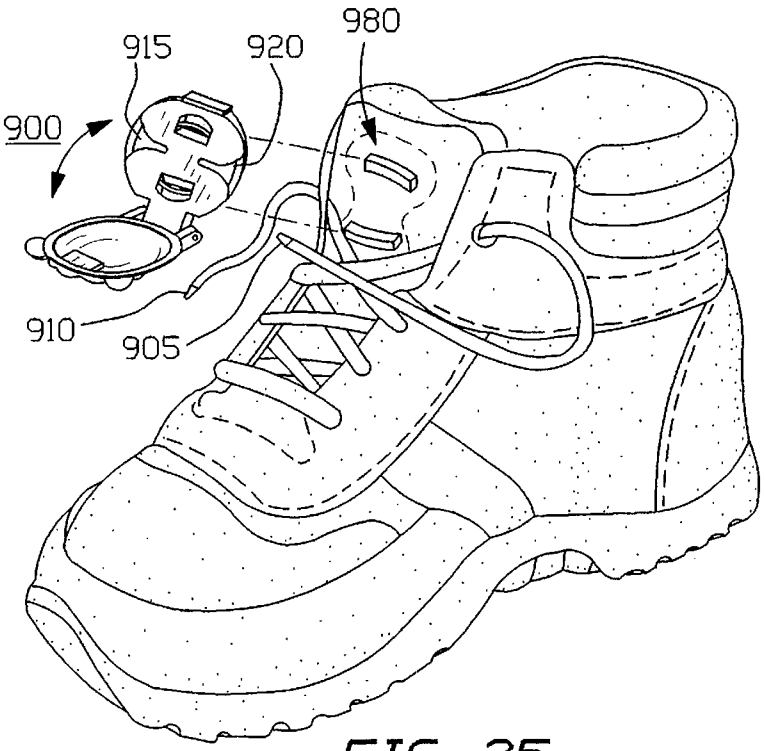
Figure 27:
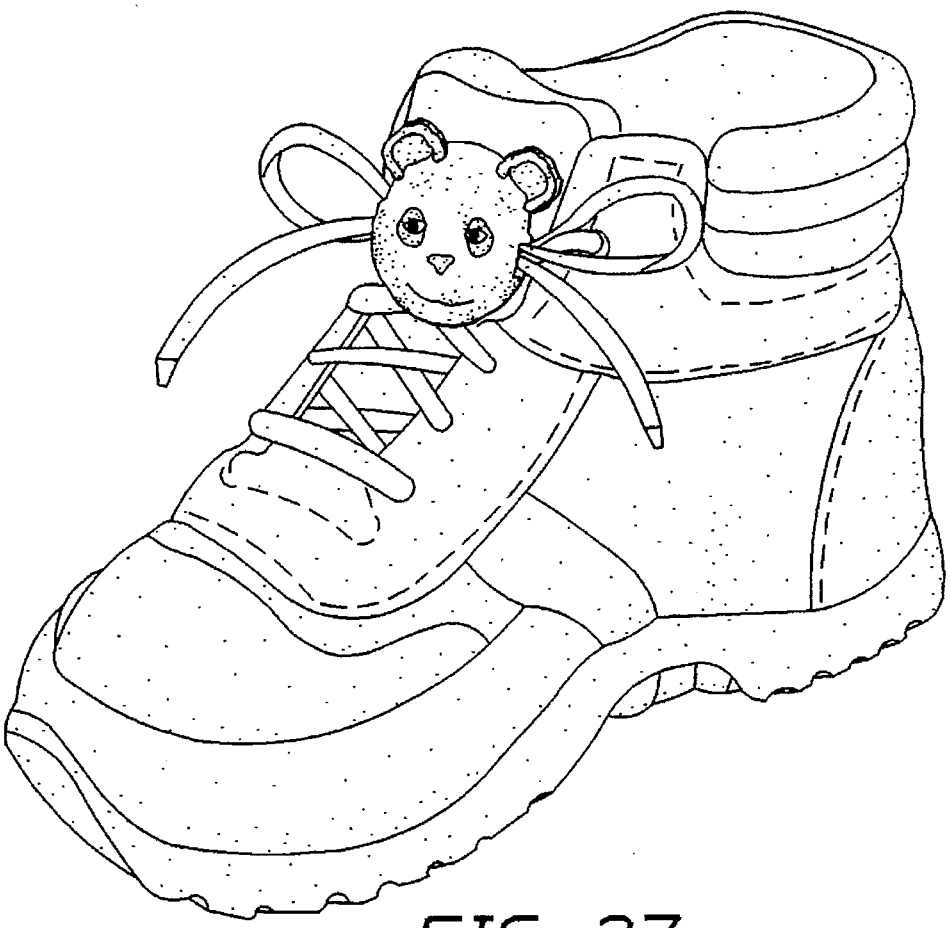
FIG. 27 shows an end product view of the present invention.

Referring now also to FIGS. 25–27, a description of how the device would appear and be used is illustrated. A device 900 has a base 910 hingeable connected to a cover 990. Device 900 further has a support 980. Shoelace end 905 and 910 are thread underneath base 910 and pulled up through side cutaways 915 and 920, and pulled towards each other through opposing slits 930, 933, respectively.

Base 910 is then snapped to support 980. Although it is difficult to disengage support 980 from base 910 at this time, device 900 allows for some degree of movement between base 910 and support 980 to allow future threading of the shoelaces through device 900. A knot may or may not be formed at this time. The opposing slits 930,933 are constructed such that the shoelaces are frictionally kept secure to the device, thus not necessitating that the laces be tied. The final step is to close cover 990 to base 910 via latching mechanism 950 and get the result as shown in FIG. 27.

Obviously, numerous modifications and variations of the present invention are possible in light of the above teachings. It is therefore understood that within the scope of the appended claims, the invention may be practiced otherwise than as specifically described herein.

What is claimed is:

1. A device for securing shoelaces, which comprises:

a) a base and a cover;

b) said base having at least a bottom, a front and a back;

c) said bottom having a pair of opposing slits extending from a periphery of said bottom towards a center of said bottom such that said pair of opposing slits do not overlap;

d) said bottom having a rim on said periphery;

e) said rim having a pair of side cutaway sections adjacent to said pair of opposing slits such that one end of the shoelace may be pulled up from underneath said bottom to one of said pair of opposing slits and another end of the shoelace may be pulled up from underneath said bottom to another of said pair of opposing slits;

f) each of said pair of opposing slits dimensioned so as to frictionally engage each of the shoelaces when the shoelaces are pulled together towards said center of said bottom thereby preventing later movement by the shoelaces;

g) means for hingeably connecting said base to said cover; and h) means for latching said base to said cover.

2. The device of claim 1, wherein said pair of side cutaway sections are U-shaped and have mouths facing said cover so as to allow easy access when threading the shoelaces through the device and permitting the shoelaces to extend outwardly from the device when the device is in a closed state.

3. The device of claim 2, wherein said pair of opposing slits are positioned approximately 180° apart.

4. The device of claim 3, wherein said cover has a plain surface for writing thereon.

5. The device of claim 1, wherein said pair of side cutaway sections are U-shaped and have mouths facing away from said cover so as to allow easy access when threading the shoelaces through the device.

6. The device of claim 5, further comprising:

a) a support component for placement on an item;

b) said support component having a means for attaching to said base; and c) said base having a complementary means for attaching to said support.

7. The device of claim 6, wherein:

a) said means for attaching includes at least one engagement arm; and b) said complementary means for attaching has at least one engagement lock aperture; wherein when said support component and said base are snapped together, a cavity exists between said support component and said base for threading the shoelaces, and said support component has a degree of movement relative to said base to permit easy access for threading the shoelaces.

8. The device of claim 7, wherein said at least one engagement arm and said at least one engagement lock aperture are curved.

9. A device for securing shoelaces, which comprises:

a) a base, a cover and a support component;

b) said base having at least a bottom, a front and a back;

c) said bottom having a pair of opposing slits extending from a periphery of said bottom towards a center of said bottom such that said pair of opposing slits do not overlap;

d) said bottom having a rim on said periphery;

e) said rim having a pair of side cutaway sections adjacent to said pair of opposing slits such that one end of the shoelace may be pulled up from underneath said bottom to one of said pair of opposing slits and another end of the shoelace may be pulled up from underneath said bottom to another of said pair of opposing slits;

f) each of said pair of opposing slits dimensioned so as to frictionally engage each of the shoelaces when the shoelaces are pulled together towards said center of said bottom thereby preventing later movement by the shoelaces;

g) means for hingeably connecting said base to said cover;

h) means for latching said base to said cover;

i) said base having a means for engaging said support component; and j) said support component having a complementary means for engaging said support component.

10. The device of claim 9, wherein:

a) said means for engaging includes at least one engagement arm; and b) said complementary means for engaging has at least one engagement lock aperture; wherein when said support component and said base are snapped together, a cavity exists between said support component and said base for threading the shoelaces, and said support component has a degree of movement relative to said base to permit easy access for threading the shoelaces.

11. The device of claim 10, wherein said at least one engagement arm and said at least one engagement lock aperture are curved.

12. The device of claim 11, wherein said pair of side cutaway sections are U-shaped and have mouths facing away from said cover so as to allow easy access when threading the shoelaces through the device.

13. The device of claim 12, wherein said pair of opposing slits are positioned approximately 180° apart.

14. The device of claim 13, wherein said cover has a plain surface for writing thereon.

15. The device of claim 9, wherein said pair of side cutaway sections are U-shaped and have mouths facing away from said cover so as to allow easy access when threading the shoelaces through the device.

16. The device of claim 15, wherein said pair of opposing slits are positioned approximately 180° apart.

17. Footwear device for securing shoelaces, which comprises:

(a) a base and a cover;

(b) said base having at least a bottom, a front and a back;

(c) said bottom having a pair of opposing slits extending from a periphery of said bottom towards a center of said bottom such that said pair of opposing slits do not overlap;

(d) said bottom having a rim on said periphery;

(e) said rim having a pair of side cutaway sections adjacent to said pair of opposing slits such that one end of the shoelace may be pulled up from underneath said bottom to one of said pair of opposing slits and another end of the shoelace may be pulled up from underneath said bottom to another of said pair of opposing slits;

(f) each of said pair of opposing slits dimensioned so as to frictionally engage each of the shoelaces when the shoelaces are pulled together towards said center of said bottom thereby preventing later movement by the shoelaces;

(g) means for hingeably connecting said base to said cover;

(h) means for latching said base to said cover;

(i) means for affixing a support component on the footwear;

(j) said support component having a means for attaching to said base;

(k) said base having a complementary means for attaching to said support; and, (l) footwear having said means for affixing, affixed thereto.

18. The device of claim 17, wherein said pair of side cutaway sections are U-shaped and have mouths facing away from said cover so as to allow easy access when threading the shoelaces through the device.

19. The device of claim 17, wherein:

a) said means for attaching includes at least one engagement arm; and b) said complementary means for attaching has at least one engagement lock aperture; wherein when said support component and said base are snapped together, a cavity exists between said support component and said base for threading the shoelaces, and said support component has a degree of movement relative to said base to permit easy access for threading the shoelaces.

20. The device of claim 19, wherein said at least one engagement arm and said at least one engagement lock aperture are curved.

* * * * *